US007314538B2

(12) United States Patent
Lashofer et al.

(10) Patent No.: US 7,314,538 B2
(45) Date of Patent: Jan. 1, 2008

(54) PROCESS AND DEVICE FOR DISCHARGING LIGNOCELLULOSE RAW MATERIALS FROM A DIGESTER AND CONVEYING THE RAW MATERIAL TO A REFINER

(75) Inventors: Wolfgang Lashofer, Vogtgasse (AT); Michael Frint, Preinsfeld (AT)

(73) Assignee: Andritz AG, Graz (AT)

( * ) Notice: Subject to any disclaimer, the term of this patent is extended or adjusted under 35 U.S.C. 154(b) by 239 days.

(21) Appl. No.: 10/797,976

(22) Filed: Mar. 11, 2004

(65) Prior Publication Data

US 2004/0238133 A1 Dec. 2, 2004

(30) Foreign Application Priority Data

Mar. 10, 2003 (AT) ..... A 359/2003

(51) Int. Cl.
*D21C 7/08* (2006.01)
*D21C 9/18* (2006.01)

(52) U.S. Cl. ..... 162/52; 162/27; 162/28; 162/56

(58) Field of Classification Search ..... 162/16, 162/56, 23, 28, 68, 18, 27, 52; 210/413; 241/28

See application file for complete search history.

(56) References Cited

U.S. PATENT DOCUMENTS

| | | | | |
|---|---|---|---|---|
| 3,841,465 | A * | 10/1974 | Miller et al. | 241/247 |
| 4,248,662 | A * | 2/1981 | Wallick | 162/19 |
| 4,259,147 | A * | 3/1981 | Gordy | 162/12 |
| 4,274,786 | A * | 6/1981 | Svensson et al. | 414/218 |
| 4,491,504 | A * | 1/1985 | Engall | 162/237 |
| 4,599,138 | A * | 7/1986 | Lindahl | 162/19 |
| 6,899,791 | B2 * | 5/2005 | Sabourin | 162/23 |

FOREIGN PATENT DOCUMENTS

GB 658104 A * 10/1951

* cited by examiner

*Primary Examiner*—Eric Hug
(74) *Attorney, Agent, or Firm*—Alix, Yale & Ristas, LLP

(57) ABSTRACT

A process for refining lignocellulose raw materials, especially wood chips, saw dust, annual plants or wood waste, includes dewatering the lignocellulose raw materials discharged from a digester, extracting condensate produced during dewatering, and refining the dewatered lignocellulose raw materials in a refiner.

5 Claims, 2 Drawing Sheets

PROCESS AND DEVICE FOR DISCHARGING LIGNOCELLULOSE RAW MATERIALS FROM A DIGESTER AND CONVEYING THE RAW MATERIAL TO A REFINER

BACKGROUND OF THE INVENTION

The present invention relates to a process and a device for discharging lignocellulose raw materials, especially wood chips, saw dust, annual plants or wood waste, from a digester and for conveying the raw material to a refiner.

It is known that in the digestion of lignocellulose raw materials, the digested material is conveyed by a discharge screw and under pressure, and by a further feed screw into a pressurized refiner.

Such devices are, for instance, known from GB 658 104. Here, in an intermediate conveyor screw, the wood chips are pressed and the hot cooking liquor is returned to the digester, in order to utilize the heat content. However, a considerable part of the cooking liquor and also foreign matters adhering to the wood chips are nevertheless conveyed into the refiner and subsequently, into the dryer.

For the purpose of the present application, all pipes, ducts, and devices connecting the digester and the refiner are subsumed under the term "connection device".

In the refiner, lignocellulose raw materials, for instance, wood chips, are defiberized. This pulp is then transported to a dryer via a blow duct, and in the dryer, the fibers are dried to a residual moisture of approx. 10% b.d.

One disadvantage of this known process consists in the fact that due to the high amount of liquid adhering to the wood chips, a high dryer capacity is needed. Another problem consists in controlling the emissions created by drying.

SUMMARY OF THE INVENTION

The present invention has the objective of making a process and a device available that overcomes the above drawbacks of conventional technology.

The present invention is based on the lignocellulose raw materials, especially wood chips, saw dust, annual plants or wood waste, being dewatered between the digester and the refiner, especially to compact the materials, and to eliminate the resulting condensate from the process. This reduces the moisture content in the wood chips, so that the dryer downstream of the refiner consumes less thermal energy for drying the fibers.

In addition, together with the condensate from dewatering, especially compaction, of the lignocellulose material, for instance wood chips, wood ingredients can be eliminated from the process, positively influencing the emissions from the dryer. With this feature savings can be achieved in the investment for exhaust gas cleaning plants.

It has been shown that the condensate eliminated from the process can be used in glue preparation, because the wood ingredients in the condensate have a favorable influence on the glue, depending on the process.

Therefore, a preferred embodiment of the present invention also refers to re-use of the condensate eliminated in the production of size.

Preferably, the compaction of the wood chips can be achieved with a plug screw at the digester discharge, i.e. by a screw whose cross section diminishes in the direction of transport.

A screen section is advantageously provided around the circumference or parts of the circumference of this screw, through which screen the liquid (condensate) adhering to the wood chips is being squeezed out.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
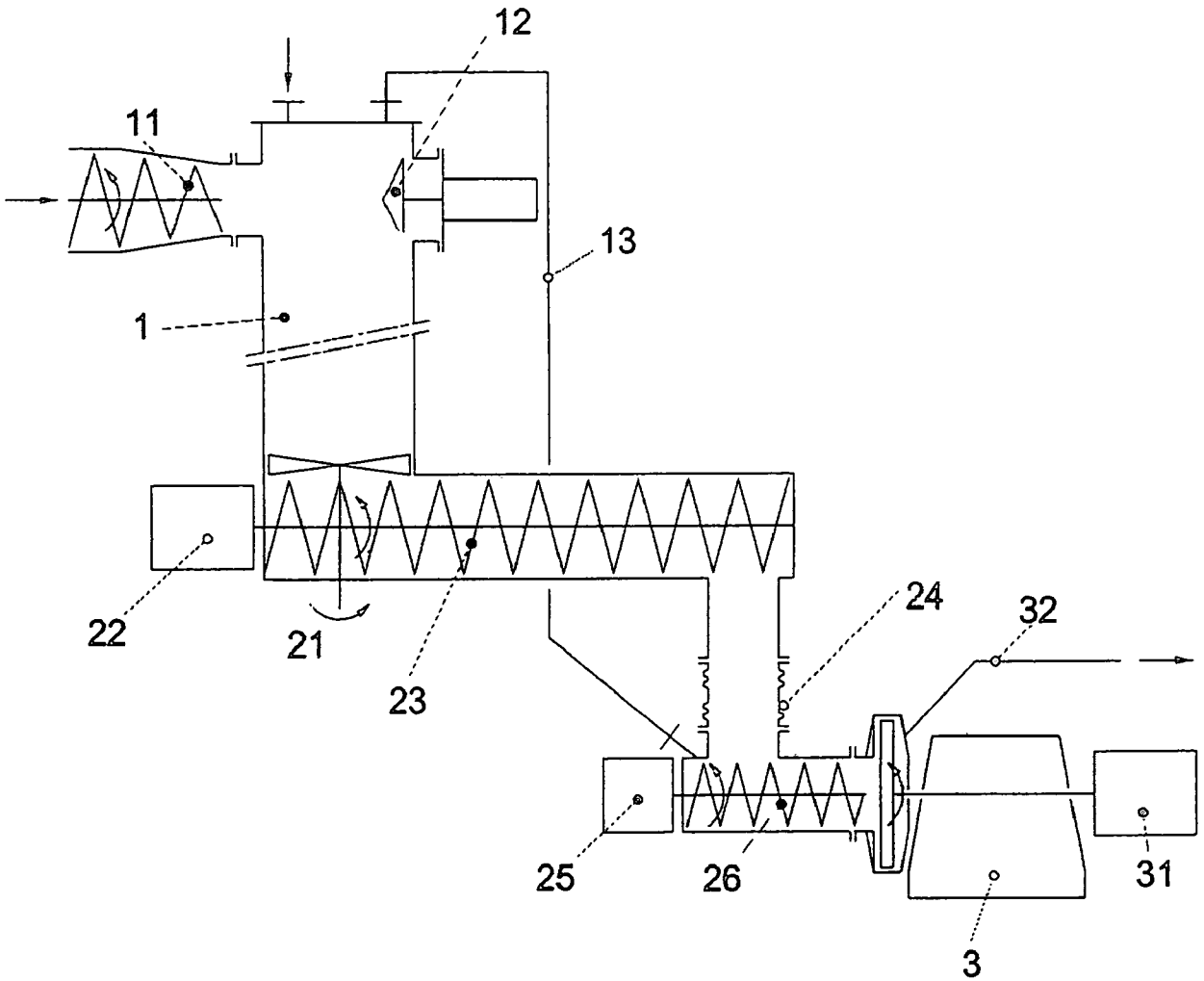
Fig. 1 Prior Art
FIG. 1 shows a schematic drawing of a system for transporting wood chips from a digester to the refiner, according to the present state of the art.

In FIG. 1, wood chips are cooked in a manner that is basically known. The wood chips are fed to digester 1 via a plug screw 11. A non-return valve for steam 12 is provided at the digester.

At the end of the cooking process, the wood chips are fed to the refiner 3 via an agitator 21 provided at the digester discharge and a conventional discharge screw 23, which is powered via drive unit 22, via compensator 24 and a feed screw 26, which is also powered via a drive unit 25.

A steam compensation pipe 13 is provided between the digester 1 and feed screw 26.

The fibers produced in the refiner are fed from the refiner 3 powered by a drive unit 31 via a blow line 32 to a dryer (not shown).

Figure 2:
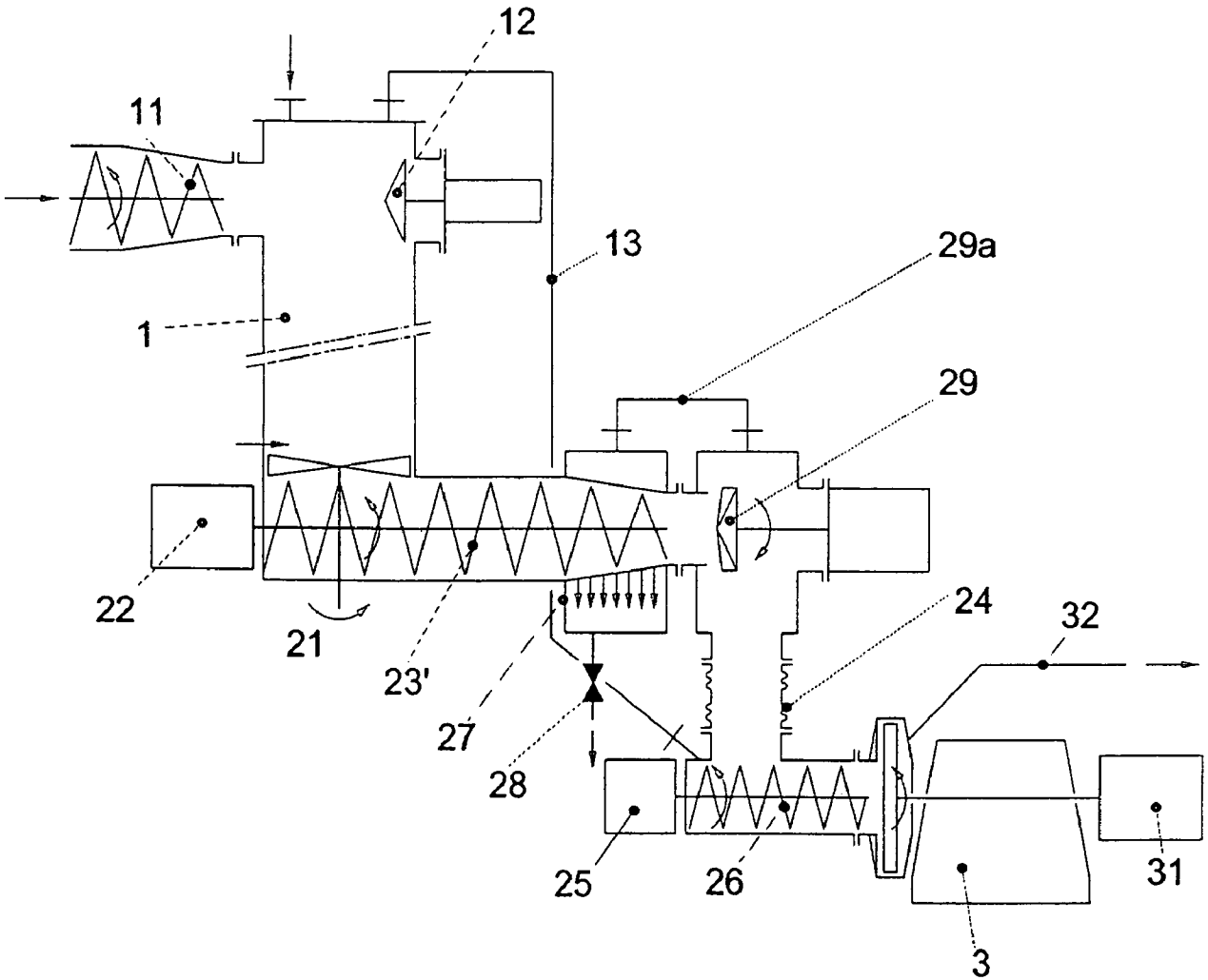
FIG. 2 shows a schematic drawing of a preferred configuration of the process according to the invention, and of the device according to the invention.

In FIG. 2, devices and parts of devices that are identical with those in the embodiment according to the state of the art and according to FIG. 1 carry the same reference numerals.

In accordance with the preferred embodiment of the present invention shown in FIG. 2, the conventional discharge screw 23 at the outlet from the digester is replaced by a plug screw 23'.

The wood chips are compacted in this plug screw 23', whose conveyance cross section decreases in the transport direction.

The liquid (condensate) resulting from this process is squeezed out through screens (not shown) and collected in a receptacle 27 while still under steam pressure. Subsequently, the condensate is discharged from the system through one or several sluices or relief valves 28 with potential back cooling for further use. The required dryer performance and also the environmental impact caused by the emissions are reduced considerably. The condensate can be used to manufacture glue preparation, because the wood ingredients in the condensate have a favorable influence on the glue, depending on the process.

A rotating peeling head 29 provided at the discharge from the plug screw further increases the homogeneity of the discharge toward the plug screw 26 and further to the refiner 3. The rotating peeling head 29 continuously peels the cake formed by the dewatered wood chips similarly to a drill. The peeling head is preferably set against the cake of wood chips at a defined pressure and operated at a controlled rotational speed.

A steam condensation line **29*a* is furthermore provided between the plug screw 23' and the compensator 24**.

What is claimed is:

1. A system for refining lignocellulose raw materials comprising:

a digester;

a refiner;

a connection device connecting the digester to the refiner;

a dewatering device provided in the connection device, the dewatering device including a plug screw separating the lignocellulose raw materials into dewatered lignocellulose raw material and water in the form of condensate;

a discharge pipe for discharging the condensate from the system; and a rotating peeling head disposed at a discharge of the plug screw.

2. The system of claim 1 wherein the dewatering device is a compaction device.

3. The system of claim 1 wherein the dewatering device is disposed at an outlet of the digester.

4. The system of claim 3 wherein the dewatering device is disposed directly below the outlet of the digester.

5. The system of claim 1 wherein the connection device defines a transport direction and the dewatering device is a screw having a diminishing cross section in the transport direction.

* * * * *